US006012645A

United States Patent [19]

Poppitz

[11] Patent Number: 6,012,645

[45] Date of Patent: Jan. 11, 2000

[54] FLOOR CLEANING MACHINE

[75] Inventor: Harold A. Poppitz, Savage, Minn.

[73] Assignee: Chaska Chemical Company, Savage, Minn.

[21] Appl. No.: 08/985,920

[22] Filed: Dec. 5, 1997

Related U.S. Application Data

[63] Continuation of application No. 08/502,789, Jul. 17, 1995, abandoned.

[51] Int. Cl.[7] ..... B05B 1/28

[52] U.S. Cl. ..... 239/104; 239/251; 239/754

[58] Field of Search ..... 239/104, 288–288.5, 239/251, 759

[56] References Cited

U.S. PATENT DOCUMENTS

| | | |
|---|---|---|
| 2,462,752 | 2/1949 | Kotches et al. . |
| 3,411,170 | 11/1968 | Kingsley . |
| 3,748,050 | 7/1973 | Poppitz . |
| 3,829,019 | 8/1974 | Petsch . |
| 3,832,069 | 8/1974 | Petsch . |
| 4,191,590 | 3/1980 | Sundheim . |
| 4,881,288 | 11/1989 | May et al. . |
| 4,903,364 | 2/1990 | Long . |
| 5,135,015 | 8/1992 | Young . |
| 5,253,809 | 10/1993 | Poppitz et al. . |
| 5,265,805 | 11/1993 | Artenian . |

FOREIGN PATENT DOCUMENTS

| | | |
|---|---|---|
| 2 221 630A | 2/1990 | United Kingdom . |

*Primary Examiner*—Kevin Weldon
*Attorney, Agent, or Firm*—Burd, Bartz & Gutenkauf

[57] ABSTRACT

A cleaning apparatus having a pan-shaped housing used to clean horizontal surfaces, such as a floor, conveyor belt and the like. Mounted on the top of the housing is a spinner assembly having a tubular shaft rotatably mounted therein carrying tubular arms located within the housing. Cleaning fluid flows through the spinner assembly into the arms and is discharged through nozzles having orifices mounted on the ends of the arms. A bolt threaded into a connector attaching one of the nozzles to an arm is adjustable to regulate liquid flow rate through the connector to adjust the speed of rotation of the arms. A flexible skirt attached to the bottom of the housing has a lower edge spaced a short distance above the surface to concentrate and prevent dissipation of the cleaning fluid. A three position valve controls the flow of water and disinfectant liquid through the cleaning apparatus.

19 Claims, 2 Drawing Sheets

FIG. 4
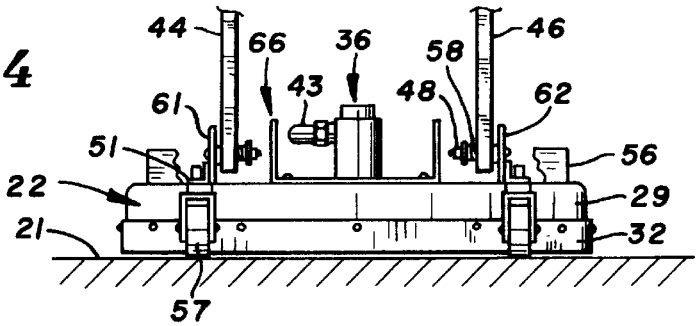
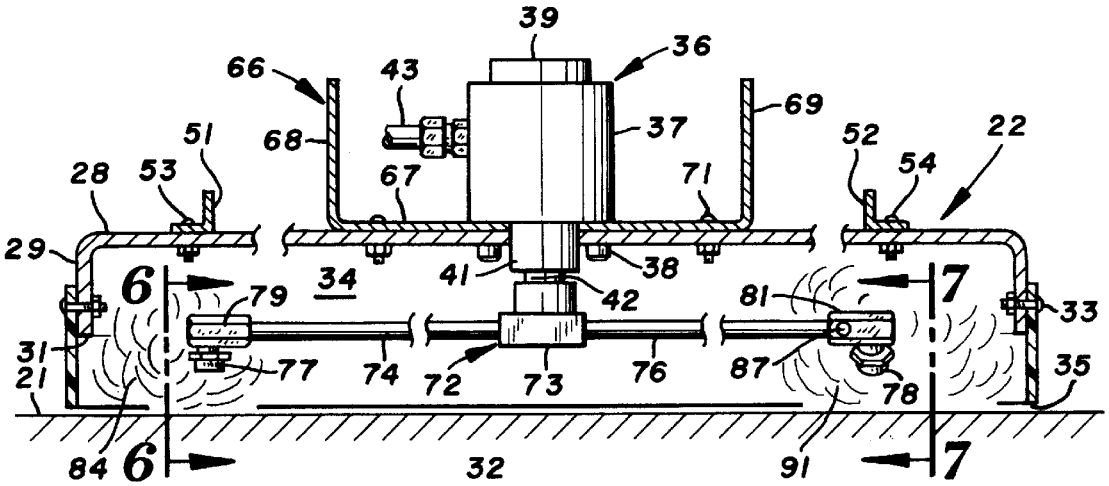
FIG. 5
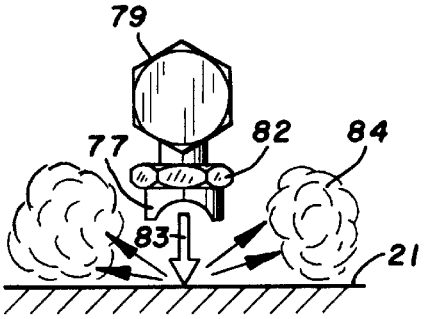
FIG. 6
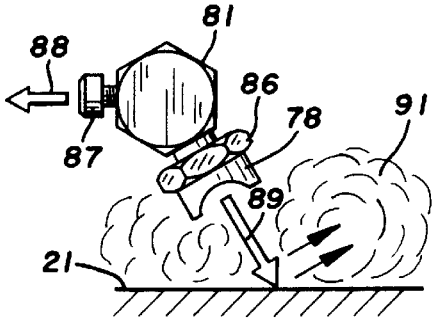
FIG. 7

FLOOR CLEANING MACHINE

CROSS REFERENCE TO RELATED APPLICATION

This application is a continuation of U.S. application Ser. No. 08/502,789, filed Jul. 17, 1995, now abandoned.

FIELD OF THE INVENTION

The invention relates to apparatus used in high pressure fluid cleaning applications.

BACKGROUND OF THE INVENTION

High fluid pressure cleaning equipment has been utilized to direct cleaning solutions to floor surfaces to be cleaned. A floor cleaner for discharging cleaning fluid under pressure to a desired location is disclosed by Poppitz in U.S. Pat. No. 3,748,050. The cleaner has an inverted pan-shaped housing enclosing a rotatable spinner assembly equipped with rotatable laterally directed arms for carrying cleaning fluid under pressure to nozzles. The bottom edge of the housing is spaced above the surface being cleaned at a relatively large distance whereby the high pressure cleaning fluid easily escapes and is not contained within the housing resulting in a lesser washing penetration and increased use of cleaning fluid.

SUMMARY OF THE INVENTION

The invention is directed to an improved cleaning apparatus for discharging fluid under pressure and disinfectant to a specific location to be cleaned. An example of a location is a food processing plant, such as a food canning, milk, ice cream, and citrus processing plants. The cleaning apparatus is useable to clean surfaces without discontinuing the processing operation of the plant and contaminating the food being processed. The apparatus has a housing including a body mounted on the housing. The body rotatably carries a shaft means. The shaft means is connected to a fluid discharging means which discharges fluid under pressure. A three position valve is used to control the flow of fluid and disinfectant liquid through the apparatus. The fluid discharging means includes nozzles having fluid discharge openings for directing jet streams of cleaning fluid toward the surface to be cleaned. The streams of fluid reflect off the surface and break up into a fine spray or mist of cleaning particles. A fluid impervious flexible skirt means attached to the housing has a lower edge located at a generally uniform and relatively close distance above the surface whereby the fine spray of cleaning particles is confined to and concentrated within the chamber of the housing above the immediate surface to be cleaned. The skirt means prevents dissipation of the cloud of cleaning fluid outside of the housing thereby increasing cleaning efficiency and conserving cleaning fluid. The flow of fluid through the fluid discharging means is adjustable to regulate the rotational speed of the fluid discharging means thereby increasing bearing life. The lower rotational speed of the fluid discharge means results in a greater direct impact force of the liquid against the surface to be cleaned. This increases cleaning efficiency and conserves water.

DESCRIPTION OF THE DRAWINGS

FIG. 4 is a front elevational view of the floor cleaning machine of FIG. 2;

FIG. 5 is a foreshorten enlarged sectional view taken along line 5—5 of FIG. 2;

FIG. 6 is an enlarged view taken along line 6—6 of FIG. 5; and

FIG. 7 is an enlarged view taken along line 7—7 of FIG. 5.

DESCRIPTION OF THE PREFERRED EMBODIMENT

Figure 1:
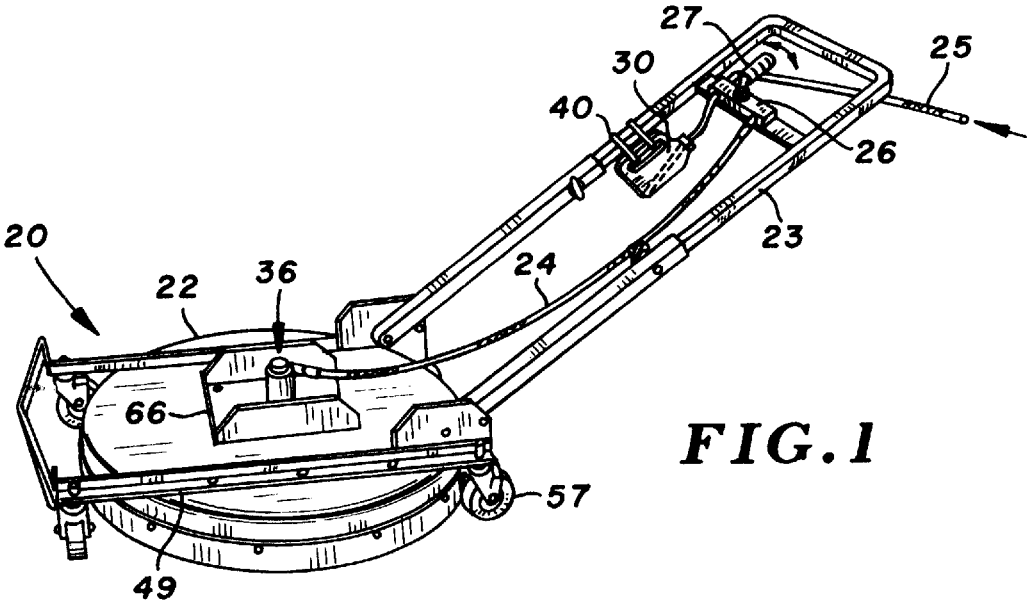
FIG. 1 is a perspective view of a floor cleaning machine of the invention.

Referring to FIG. 1, there is shown a floor cleaning machine indicated generally at 20, useable on a horizontal surface 21 to be cleaned. Cleaner 20 functions to dispense high pressure fluid, such as a cleaning solution, germicidal detergent, or disinfectant sanitizer, onto surface 21 and form a cloud of cleaning material to mechanically scrub the surface and effect a cleaning operation. Cleaner 20 can be used to clean surfaces such as floors, conveyor belts, swimming pool bottoms, food processing plants, including but not limited to food canning, milk, ice cream and citrus processing plants and the like. Cleaner 20 is a portable unit that can be readily moved and used to clean floors and horizontal surfaces in numerous places, including but not limited to food processing, meat packing, dairy processing and the like, without discontinuing the processing operation of the plant and contaminating the food being processed. The discharge end of cleaner 20 has a cleaning head or housing 22 connected to handlebar 23. The cleaning solution used is preferably water added to a chemical disinfectant liquid. Cleaner 20 can also be used for high pressure rinsing with water in the range of 800 to 1000 psi.

Cleaner 20 has a three position valve 26 for controlling the flow of water under pressure in hose 25 from a pump or other pressure source (not shown). A bottle 30 attached to the side of handlebar 23 with straps 40 contains a chemical disinfectant liquid. A tube connects bottle 30 with valve 26. When lever 27 is moved to the right position a venturi is created whereby the water flowing through valve 26 draws disinfectant liquid from bottle 30 into the flowing water. When lever 27 is moved to the left position only water flows through valve 26 into hose 24. The middle position of lever 27 closes valve 26.

Referring to FIGS. 2 to 5, housing 22 is a generally circular, pan-shaped member having a substantially flat top wall 28 joined to a continuous annular side wall 29. Housing 22 can have other shapes, such as rectangular, square, triangular, hexagonal or octagonal shapes. The lower or outer edge of side wall 29 terminates in a continuous bottom edge 31. Bottom edge 31 lies in a generally horizontal plane that is spaced from top wall 28 to define a chamber 34. An annular flexible skirt 32 is secured with a plurality of fasteners 33 to the bottom portion of side wall 29. Skirt 32 has a substantially uniform length whereby the bottom end 35 of skirt 32 is located in substantially the same horizontal plane as that of surface 21. As shown in FIG. 5, bottom end 35 is located at a generally uniform and relatively close distance above surface 21, such as ⅛ of an inch or less. Skirt 32 is a continuous fluid impervious annular band of rubber or plastic material that confines high pressure cleaning fluid to the immediate surface to be cleaned. Fluid jets 83 and 89 deflecting off surface 21 form a fine spray or mist 84, 91 of cleaning fluid particles within chamber 34. Skirt 32 prevents dissipation of mist 84, 91 so that the disinfectant contained therein thoroughly disinfects and cleans surface 21. Skirt 32 confines and concentrates the discharge of cleaning fluid to chamber 34 and provides for an intimate mixing and breakdown of the cleaning fluid with the air with chamber 34 forming mist 84, 91. The mixture of air and cleaning fluid is confined to chamber 34 and does not contaminate the air outside of the cleaner 20. In food processing plants, cleaner 20 can be used without stopping the processing operation as the cleaning fluid does not flow outside of housing 22. The result is that there is greater washing and disinfectant penetration with a minimum use of cleaning fluid. Skirt 32 preferably is made of flexible and fluid impervious plastic material. Other flexible non-permeable materials can be used to construct skirt 32.

Figure 2:
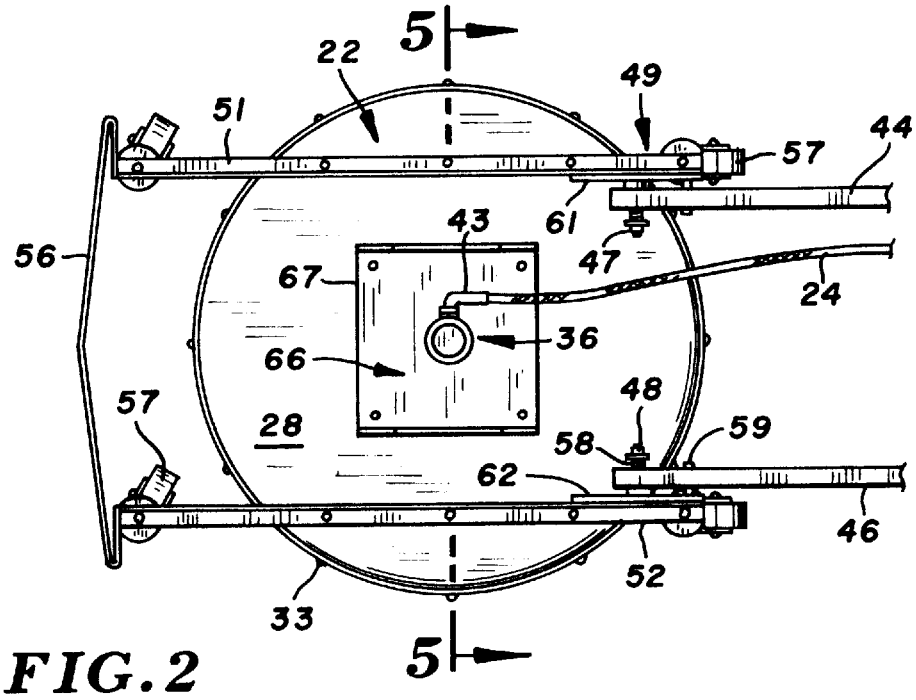
FIG. 2 is an enlarged top view of the floor cleaning machine of FIG. 1.

Referring to FIG. 2, a spinner assembly indicated generally at 36 is mounted in the center portion of housing top wall 28. Cleaning fluid under pressure is supplied to spinner assembly 36 through a tubular hose 24. As shown in FIG. 5, spinner assembly 36 has a short, upright cylindrical body 37. The lower end of body 37 is attached to top wall 28 with a plurality of bolts 38. Bolts 38 extend through top wall 13 and are threaded into threaded holes in body 37 to attach spinner assembly 36 to housing 22. Body 37 has a longitudinal passage accommodating an elongated tubular shaft 42. A plug or cap 39 closes the top of body 37. Shaft 42 is rotatably mounted on a bearing located in body 37. A boss 41 on the bottom of body 33 has an inwardly directed annular lip engaging the lower end of the bearing to hold the bearing and shaft 42 within body 37. Shaft 42 has a longitudinal passage for carrying cleaning fluid under pressure into the inside of housing 22.

The upper portion of body 37 has a lateral bore accommodating one end of an elbow pipe fitting 43. Hose 24 is connected to the opposite end of fitting 43. Cleaning fluid under pressure flows through hose 24 and into spinner assembly 36 via fitting 43. Fluid moves through spinner assembly 36 and into liquid distributor 72 for distribution. When fluid under pressure is discharged from liquid distributor 72, shaft 42 is rotated by distributor 72. Fluid moving through spinner assembly 36 permits substantially free rotation of shaft 42 relative to body 37. A spinner assembly permitting substantially free rotation of the shaft without lateral movement and vibration of the shaft is disclosed by Poppitz et al in U.S. Pat. No. 5,253,809.

Figure 3:
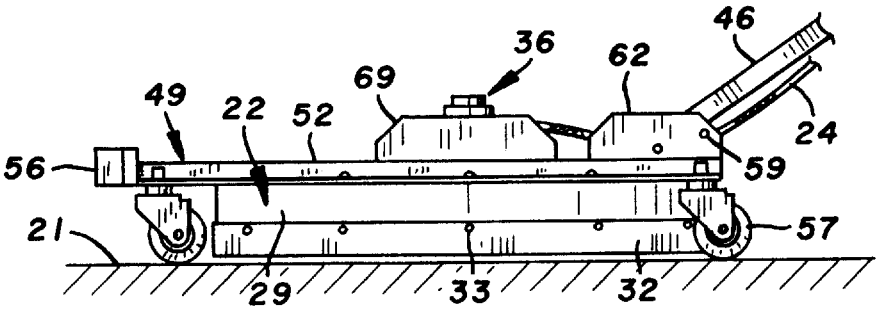
FIG. 3 is a side elevational view of the floor cleaning machine of FIG. 2.

Referring to FIGS. 2 and 3, handlebar 23 is a generally U-shaped member having a pair of transversely spaced lower ends 44 and 46 connected to upright plates 61 and 62 of frame 49 supporting housing 22. Ends 44 and 46 are located on opposite sides of frame 49 and are pivotally secured to plates 61 and 62 with nut and bolt assemblies 47 and 48. Springs 58 mounted on bolt assemblies 47 and 48 engage ends 44 and 46 of handlebar 23 to bias ends 44 and 46 toward plates 61 and 62 thereby limiting pivotal movement of handlebar 23. Bolt assemblies 47 and 48 can be tightened to lock the position of handlebar 23 relative to frame 49. Ends 44 and 46 engage inwardly projecting pins 59 joined to plates 61 and 62 when handlebar 23 is in a diagonal position, as shown in FIGS. 1 and 2.

Referring to FIGS. 2 and 5, frame 49 has a pair of elongated side rails 51 and 52 that are attached to top wall 28 of housing 22 with fasteners 53 and 54. A V-shaped bumper 56 extends between the front ends of rails 51 and 52. Caster wheels 57 are pivotally mounted to each corner of frame 49 support cleaner 20 whereby cleaner 20 may be moved to selected cleaning locations on surface 21. Located adjacent the inner side of rails 51 and 52 is a rectangular guard plate or shield 66. Shield 66 has a generally flat wall 67 that surrounds spinner assembly 36. The outer side portions of wall 67 have sections 68 and 69 turned upright thereby shielding and preventing damage to spinner assembly 36 and fitting 43. A plurality of fasteners 71 attach shield 66 to top wall 28 of housing 22.

Referring to FIG. 5, a liquid distributor indicated generally at 72, secured to spinner assembly 36 is used to distribute liquid under pressure to the surface to be cleaned. Liquid distributor 72 has a hub 73 located under top wall 28 of housing 22. Hub 73 is mounted on the lower threaded end of shaft 42. Hub 73 has a pair of oppositely directed lateral bores accommodating outwardly projected tubular arm members 74 and 76. Nozzles 77 and 78 are attached to the outer ends of arms 74 and 76 with connectors 79 and 81. Each nozzle 77, 78 has a fluid discharge opening or orifice operable to direct a jet curtain of fluid under pressure as indicated by arrows 83 and 89, shown in FIGS. 6 and 7, respectively, toward surface 21 to be cleaned. Jet 83 deflects directly off surface 21 and forms cloud 84. Jet 89 deflects off surface 21 at an angle and forms cloud 91. Clouds 84 and 91 of cleaning fluid are contained within chamber 34 of housing 22 by skirt 32 to prevent dissipation of clouds 84 and 91. This maintains cleaning fluid concentration in chamber 34 thereby increasing cleaning action of cleaner 20 whereby less fluid is needed to clean surface 21.

Connector 79, as shown in FIGS. 5 and 6, is a one-piece member having an elongated body with an outer, hexagonal-shaped peripheral surface to accommodate a wrench. A passage extends through connector 79. The inner end of the passage of connector 79 is threaded to accommodate the threads on the outer end of arm 74. Nozzle 77 is threaded on the downwardly directed outer end of connector 79. The inner end of nozzle 77 has a hexagonal-shaped outer surface 82 to facilitate the tightening of nozzle 77 on connector 79. The discharge orifice of nozzle 77 is a transverse slot extending from the sides of nozzle 77 and is open to the passage of connector 79. As shown in FIG. 6, nozzle 77 is downwardly directed normal to the horizontal or longitudinal axis of connector 79. Jet 83 of cleaning fluid is discharged as a substantially flat curtain of high pressure fluid from nozzle 77 toward surface 21 to be cleaned. The direct discharge of the cleaning fluid from nozzle 77 toward surface 21 forms cloud 84 of fine particles of cleaning fluid which is contained within chamber 34 with skirt 32 which increases cleaning efficiency of cleaner 20 with a minimum of fluid use.

Connector 81, as shown in FIGS. 5 and 7, has substantially the same structure as connector 79. Connector 81 has an elongated body having an inner passage and a hexagonal-shaped outer surface to accommodate a wrench. The inner end of connector 81 has threads to accommodate threads on the outer end of arm 76. Nozzle 78 is threaded on the downwardly directed outer end of connector 81. The inner end of nozzle 78 has a hexagonal-shaped outer surface 86 to facilitate the tightening of nozzle 78 on connector 81. Nozzle 78 has a discharge orifice or transverse slot extending from opposite sides thereof. The slot is open to the passage of connector 81. As shown in FIG. 7, nozzle 78 is inclined downwardly at an angle of approximately 45 degrees with respect to the horizontal or longitudinal axis of connector 81. The size of the passage of connector 81 is controlled by a bolt 87 threaded into the side wall of connector 81. Bolt 87 is adjustable to extend into the passage of connector 81 to regulate the size of the passage thereby control flow of liquid through cleaner 20. An optimal cleaning efficiency with minimized liquid expenditure can be achieved by regulating flow rate of liquid through cleaner 20 thereby regulating rotational speed of liquid distributor 72 with adjustment of bolt 87 and the angle of inclination of nozzle 78. Bolt 87 can be used to decrease flow of liquid through connector 81 to a rate whereby liquid distributor 72 has a slower rotation to increase cleaning action due to increased direct liquid impact force. The speed of rotation of liquid distributor 72 may also be controlled by adjusting the angle nozzle 78 inclines downwardly with respect to the horizontal or longitudinal axis of connector 81. Increased cleaning efficiency is achieved by slowing the rotational speed of liquid distributor 72 with movement of nozzle 78 into a more direct orientation with surface 21 to be cleaned. High speed rotation causing less direct liquid impact force and less cleaning action is avoided. Also, reducing the speed of rotation of liquid distributor 72 reduces the rotational speed of spinner assembly 36 and results in a decrease in wear on the bearing of spinner assemble 36. Bolt 87 can be threaded outwardly, as indicated by arrow 88 in FIG. 7, to increase liquid flow rate through distributor 72 when increased cleaning action is desired. Also, nozzles 77 and 78 can have larger discharge openings for greater cleaning action, such as openings to allow five gallons of water at 1000 psi.

In use, lever 27 is either moved to the right position to draw disinfectant from bottle 30 into the flow of water under pressure or it is moved to the left position to allow only water to flow through valve 26 into hose 24 whereby a jet 83 of fluid is discharged as a substantially flat curtain of high pressure fluid from nozzle 77 directly toward surface 21 to be cleaned. Jet 89 is discharged at an angle from nozzle 78 toward surface 21. The angular discharge of the cleaning fluid from nozzle 78 provides nozzle 78 with a horizontal force component which rotates arms 74 and 76, hub 73 connected to the arms, and shaft 42. Jet 83 discharged directly at surface 21 creates a direct liquid impact force resulting in maximum cleaning action. Jets 83 and 89 deflect off surface 21 and form cleaning mist 84 and 91. Skirt 32 retains mist 84 and 89 in close proximity to surface 21 increasing cleaning and disinfecting thereof. Also the angle of inclination of jet 89 and the rate of flow of liquid through connector 81 each can be varied to vary the rotational speeds of liquid distributor 72 and spinner assembly 36 thereby increasing cleaning efficiency, reducing bearing wear and reducing water use.

While there has been shown and described a preferred embodiment of the floor cleaning machine of the invention, it is understood that changes in structure, arrangement of structure, and materials may be made by those skilled in the art without departing from the invention. The invention is defined in the following claims.

What is claimed is:

1. An apparatus for discharging fluid under pressure for cleaning a surface in a food processing plant without discontinuing the food processing comprising: a frame, a housing having a top wall and a side wall defining a chamber having an open bottom facing a surface to be cleaned, means mounting the housing on the frame, a body mounted on the top wall of the housing, shaft means rotatably mounted on the body, hose means connected to the body for carrying fluid under pressure to the body, means for supplying a disinfectant into the fluid carried by the hose means to the body, valve means for controlling the flow of the disinfectant into the fluid carried by the hose means, a pair of arms secured to the lower end of the shaft means located within said chamber so that the shaft means rotates upon rotation of the arms within the chamber, each arm having a nozzle mounted on the outer end of said arm, each nozzle having a fluid discharge opening for distributing the fluid and disinfectant under pressure toward a surface to be cleaned, said fluid and disinfectant distributed into the chamber of the housing deflecting off the surface below the chamber of the housing generating a fine spray of fluid and disinfectant, one of the discharge openings directed at an angle toward the surface so that the angular discharge of the fluid causes said arms to rotate, the other discharge opening is directed generally perpendicular to the surface, said skirt means attached to the side wall of the housing, a skirt means having a continuous bottom edge located in close proximity above the surface to confine and concentrate the fine spray of fluid and disinfectant to the chamber of the housing immediately above the surface, said skirt means comprises a fluid impervious annular band secured to a bottom portion of the side wall, the band having a continuous bottom edge located at a generally uniform and relatively close distance above the surface to confine the fine spray of fluid and disinfectant to the chamber immediately above the surface, wheel means attached to the frame to movably support the housing above the surface and maintain the bottom edge of the band at said generally uniform and relatively close distance above the surface to be cleaned, and handle means connected to the housing for facilitating movement of the housing to selected locations on the surface.

2. The apparatus of claim 1 wherein: the valve means also controls the flow of fluid under pressure in the hose means.

3. The apparatus of claim 1 wherein: the nozzle with the discharge opening directed at an angle toward the surface has means operable to regulate the fluid flow rate through said arms and regulate the rotational speed of said arms.

4. The apparatus of claim 1 wherein: the wheel means maintains the bottom edge approximately ⅛ of an inch above the surface.

5. The apparatus of claim 1 wherein: the skirt is made from a non-permeable plastic material.

6. A cleaning assembly for discharging fluid under pressure and disinfectant fluid to a surface to be cleaned in a food processing plant without discontinuing the food processing, the cleaning assembly comprising: a frame, a housing connected to the frame, the housing having a top wall and a side wall defining a chamber open to the surface to be cleaned, a body mounted on the top wall of the housing, tubular shaft means rotatably mounted on the body, hose means connected to the body for carrying the fluid under pressure and disinfectant fluid to the body, bottle means for accommodating the disinfectant fluid, valve means in communication with said hose means and bottle means for selectively controlling the flow of the fluid under pressure and fluid mixed with disinfectant fluid to the body, arm means mounted on the lower end of the tubular shaft means located within said chamber, the arm means including means for discharging the fluid under pressure and disinfectant fluid supplied to the body toward the surface thereby rotating said arms, and cleaning the surface, said fluid discharged under pressure toward the surface deflecting off the surface generating a fine spray of fluid and disinfectant fluid, skirt means attached to the housing operable to contain and concentrate the fine spray of fluid and disinfectant fluid to the chamber of the housing, the skirt means comprising a fluid impervious annular band having a bottom edge spaced at a generally uniform and relatively close distance above the surface whereby the fine spray of fluid and disinfectant is confined to the chamber of the housing, and wheel means attached to the frame to movably support the housing above the surface and maintain the bottom edge of the band at said generally uniform and relatively close distance above the surface to be cleaned.

7. The assembly of claim 6 including: handle means connected to the frame.

8. The assembly of claim 6 including: guard means secured to the housing, the guard means having upright portions extended adjacent the body.

9. The assembly of claim 6 wherein: the valve means is a three position valve connected to the hose means, the valve having a lever movable to a first open position to allow the fluid under pressure to flow through the valve and hose means to the body and to draw the disinfectant fluid from the bottle means into the fluid under pressure flowing to the body, the lever being movable to a second open position for allowing only the fluid under pressure to flow to the body, the lever being movable to a closed position to close the valve.

10. The assembly of claim 6 wherein: the bottle means includes a tube connected to the valve means to allow the disinfectant fluid to be drawn into the fluid under pressure to the body.

11. The assembly of claim 6 wherein: the skirt means is a flexible non-permeable plastic annular member attached to the housing.

12. The assembly of claim 6 wherein: the arm means includes means operable to regulate fluid flow rate and rotational speed of the arm means.

13. A cleaning assembly for cleaning a surface in a food processing plant without discontinuing the food processing comprising: a frame, handle means connected to one end of the frame, a housing connected to the frame, the housing having a chamber open to the surface to be cleaned, a spinner assembly having a body mounted on the housing, a tubular shaft rotatable mounted on the body, a hose connected to the spinner assembly for carrying fluid under pressure to the spinner assembly, means for supplying disinfectant fluid to the fluid under pressure carried to the spinner assembly, valve means for selectively controlling the flow of the fluid under pressure and supply of the disinfectant fluid to the spinner assembly in communication with said hose, said valve means including a three-position valve connected to the hose, the valve having a lever movable to a first open position to allow the fluid under pressure to flow through the valve and hose to said spinner assembly and to draw the disinfectant fluid from the means for supplying the disinfectant fluid into the fluid under pressure flowing to the spinner assembly, the lever being movable to a second open position for allowing only the fluid under pressure to flow to the spinner assembly, the lever being movable to a third closed position to close the valve to prevent fluid and disinfectant from flowing in the hose, a pair of arms secured to the lower end of the shaft to receive the fluid under pressure and disinfectant fluid discharged from the spinner assembly and distribute the fluid under pressure and disinfectant fluid toward the surface to be cleaned, said fluid and disinfectant distributed into the chamber of the housing deflecting off the surface below the chamber of the housing generating a fine spray of fluid and disinfectant, a continuous fluid impervious annular band attached to the housing, the band having a bottom edge spaced at a relatively close distance above the surface to contain and concentrate the fine spray of fluid and disinfectant fluid to the chamber, and wheel means attached to the frame to movably support the housing above the surface and maintain the bottom edge of the band spaced at a relatively close distance above the surface to be cleaned.

14. The assembly of claim 13 wherein: one of the arms includes means adjustable to regulate fluid flow rate through the arms and the rotational speed of the arms and spinner assembly.

15. The apparatus of claim 13 including: guard means secured to the housing, the guard means having upright portions extended adjacent the spinner assembly.

16. The apparatus of claim 13 wherein: the means for supplying the disinfectant fluid to the fluid under pressure carried to the spinner assembly comprises a bottle secured to the handle means for accommodating the disinfectant fluid, and a tube connected to the bottle for carrying the disinfectant fluid to the means for selectively controlling the flow of fluid under pressure.

17. A cleaning apparatus for cleaning and disinfecting a surface in a food processing plant without discontinuing the food processing comprising: a frame, a housing having a top wall and a continuous side wall joined to the top wall to define an inner chamber open to the surface, means mounting the housing on the frame, a spinner assembly mounted on the housing, the spinner assembly having a shaft rotatably mounted thereon, a hose connected to the spinner assembly for supplying a fluid under pressure and a disinfectant to the spinner assembly, a valve in communication with the hose for selectively controlling the supply of the fluid under pressure and disinfectant to the spinner assembly, said valve is a three-way valve member having a lever movable to a first open position to allow both the fluid under pressure and the disinfectant to be supplied to the spinner assembly, the lever being movable to a second open position to allow only the fluid under pressure to be supplied to the spinner assembly, the lever being movable to a third closed position to close said valve member to prevent fluid and disinfectant from flowing in the hose, an arm secured to the shaft for distributing the fluid under pressure and disinfectant supplied to the spinner assembly toward the surface, said fluid and disinfectant distributed into the chamber of the housing deflecting off the surface below the chamber of the housing generating a fine spray of fluid and disinfectant, said arm having a nozzle located within said chamber, said nozzle having an opening directed toward the surface for discharging the fluid under pressure and disinfectant toward the surface to clean the surface and rotate said arm, a continuous fluid impervious band secured to the housing, the band having a lower edge spaced above the surface at a predetermined distance so as to confine the fine spray of fluid and disinfectant to said chamber, and wheel means attached to the frame to movably support the housing above the surface and maintain the bottom edge of the band at said predetermined distance above the surface.

18. The cleaning apparatus of claim 17 including: a bottle for accommodating the disinfectant, the bottle having a tube in communication with the valve member to supply disinfectant to the spinner assembly when the lever is moved to the first open position.

19. The cleaning apparatus of claim 17 wherein: the wheel means maintains the lower edge of said band above the surface at most one-eighth of an inch.

* * * * *